US010156086B2

(12) United States Patent
Hart et al.

(10) Patent No.: US 10,156,086 B2
(45) Date of Patent: Dec. 18, 2018

(54) DUAL ENTRY SAFETY CUFF PORT

(71) Applicants: Mike Wayne Hart, Glenwood, UT (US); Alan Hart, Richfield, UT (US); Dave Bingham, Spring City, UT (US)

(72) Inventors: Mike Wayne Hart, Glenwood, UT (US); Alan Hart, Richfield, UT (US); Dave Bingham, Spring City, UT (US)

( * ) Notice: Subject to any disclaimer, the term of this patent is extended or adjusted under 35 U.S.C. 154(b) by 0 days.

(21) Appl. No.: 15/156,082

(22) Filed: May 16, 2016

(65) Prior Publication Data

US 2016/0333610 A1 Nov. 17, 2016

Related U.S. Application Data

(60) Provisional application No. 62/162,472, filed on May 15, 2015.

(51) Int. Cl.

*E05B 65/00* (2006.01)
*E05B 75/00* (2006.01)
*E06B 5/10* (2006.01)

(52) U.S. Cl.

CPC ..... *E05B 65/0017* (2013.01); *E05B 75/00* (2013.01); *E06B 5/10* (2013.01)

(58) Field of Classification Search

CPC ..... E06B 7/28; E06B 75/00; E06B 15/0046
USPC ..... 49/171; 70/16, DIG. 35; 109/45, 58, 109/58.5, 59 R

See application file for complete search history.

(56) References Cited

U.S. PATENT DOCUMENTS 64,975 A * 5/1867 Harris ..... E05B 63/0017 70/134
700,863 A * 5/1902 Wansbrough ..... E06B 7/32 49/169
1,576,656 A * 3/1926 Honsinger ..... E05G 7/002 109/19
2,347,137 A * 4/1944 Steele ..... E06B 3/2605 160/128
4,001,970 A * 1/1977 Miyamoto ..... E06B 7/30 49/171
4,022,263 A * 5/1977 Beckett ..... E06B 7/32 119/484
4,127,967 A * 12/1978 Franzl ..... E06B 7/28 16/82
4,145,978 A * 3/1979 Johnson ..... E05B 65/02 109/59 R
4,148,265 A * 4/1979 Acosta ..... E05B 65/006 109/59 R
4,216,743 A * 8/1980 Cohen ..... G07C 9/00722 119/484
4,384,376 A * 5/1983 Shrode ..... A47K 3/30 4/596
4,615,281 A * 10/1986 Gaston ..... E05B 19/0005 109/46

(Continued)

*Primary Examiner* — Suzanne L Barrett
(74) *Attorney, Agent, or Firm* — Dodd Call Black, PLLC; Dustin L. Call

(57) ABSTRACT

A dual entry safety cuff port for use in a correctional facility. The dual entry safety cuff port includes a frame and a panel, the panel configured to slide within the frame between a fully open position and a closed position. The dual entry safety cuff port also includes a lock. The lock configured to allow operation of the dual entry safety cuff port from either side of the panel. The dual entry safety cuff porter further includes a flange on the panel, the flange configured to stop the panel in the fully open position.

20 Claims, 3 Drawing Sheets

(56) References Cited

U.S. PATENT DOCUMENTS 4,995,336 A * 2/1991 Deemer ..... E06B 7/32 119/484
5,579,605 A * 12/1996 Tanaka ..... E06B 7/32 49/171
6,336,293 B1 * 1/2002 Kamimura ..... E06B 7/02 49/171
6,378,769 B1 * 4/2002 Wolgamot ..... E06B 7/32 109/68
6,669,144 B2 * 12/2003 Artsiely ..... B64C 1/1469 244/118.5
6,698,690 B2 * 3/2004 Novak ..... B64C 1/1423 244/118.5
6,810,625 B2 * 11/2004 Thomas ..... B60J 1/17 49/171
7,216,650 B1 * 5/2007 Merriweather ..... E05B 75/00 119/770
8,397,618 B2 * 3/2013 White ..... F41H 5/26 52/741.3
8,733,020 B2 * 5/2014 Khoshkish ..... E06B 7/30 49/171
9,016,558 B2 * 4/2015 Alexander ..... E06B 7/32 109/67
9,284,773 B1 * 3/2016 Fridley ..... E06B 7/32
2001/0039905 A1 * 11/2001 Alexander ..... E06B 7/28 109/67
2004/0069417 A1 * 4/2004 Sun ..... E06B 7/28 160/107
2006/0201638 A1 * 9/2006 Hesketh ..... E06B 7/32 160/180
2006/0260196 A1 * 11/2006 Cheng ..... E06B 7/30 49/171
2008/0134584 A1 * 6/2008 McGhee ..... E06B 7/32 49/484.1
2010/0175336 A1 * 7/2010 Sullivan ..... E06B 3/4636 52/173.1
2012/0153783 A1 * 6/2012 Shoenfeld ..... A61L 2/10 312/209

* cited by examiner

DUAL ENTRY SAFETY CUFF PORT

CROSS-REFERENCE TO RELATED APPLICATIONS

This application claims the benefit of and priority to U.S. Provisional Patent Application Ser. No. 62/162,472 filed on May 15, 2015, which application is incorporated herein by reference in its entirety.

BACKGROUND OF THE INVENTION

Correctional or detention facilities provide safety, security and protection for the public by detaining and housing violent criminals. Inside these facilities there are many heavy steel doors that separate the violent offenders (inmates) from officers and keep the offenders in a secure environment. Built within these heavy steel doors is a mechanism called a "cuff port." The basic cuff port consists of a small opening (or hole) in the main steel door that is covered by a piece of steel that is secured to the door with one or more hinges and a locking mechanism. When in use, the cuff port is unlocked and the door swings open in one direction which allows the offender to place their hands through the opening of the cuff port so the law enforcement officer (correctional officer) can secure the offender with hand cuffs before the main door is opened. Maintaining control is a must for the safety of both the officer and the offender.

Within a correctional facility vulnerable areas exist where inmates are released from the secured environment of their housing unit and allowed into common areas such as hallways and rotundas (a central point where all hallways intersect). In these areas there are steel doors that provide separation between the secure housing units that they live and these common areas. What makes these areas vulnerable is that the main steel doors that separate these areas do not have an operating cuff port, giving the offenders opportunities to act in a violent manner, such as attacking and assaulting other inmates and officers knowing that the responding officers have little to no control of the situation. This not only leaves officers at risk of serious injury or death, it also leaves other offenders at risk of serious injury or death leaving a large liability issue for the department. That in the end, could cost tax payers more in the long term due to legal issues resulting from these incidents.

Accordingly, there is a need in the art for a cuff port that can be opened from either side. Moreover, there is a need in the art for a cuff port that can be retrofit to existing doors.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a dual entry safety cuff port for use in a correctional facility. The dual entry safety cuff port includes a frame and a panel, the panel configured to slide within the frame between a fully open position and a closed position. The dual entry safety cuff port also includes a lock. The lock configured to allow operation of the dual entry safety cuff port from either side of the panel. The dual entry safety cuff porter further includes a flange on the panel, the flange configured to stop the panel in the fully open position.

Another example embodiment includes a dual entry safety cuff port for use in a correctional facility. The dual entry safety cuff port includes a frame, the frame including steel tubing that can be bonded to a steel security door. The dual entry safety cuff port additionally includes an opening within the frame and a panel, the panel configured to slide within the frame between a fully open position and a closed position. The dual entry safety cuff port also includes a lock. The lock configured to allow operation of the dual entry safety cuff port from either side of the panel, lock the panel in the fully open position and lock the panel in the closed position. The dual entry safety cuff porter further includes a flange on the panel, the flange configured to stop the panel in the fully open position.

Another example embodiment includes a dual entry safety cuff port for use in a correctional facility. The dual entry safety cuff port includes a frame, the frame including steel tubing that can be bonded to a steel security door. The dual entry safety cuff port additionally includes an opening within the frame and a channel in at least a portion of the perimeter of the opening. The dual entry safety cuff port also includes a panel, the panel configured to slide within the frame between a fully open position and a closed position. The dual entry safety cuff port also includes an access panel, wherein the access panel allows access to the interior of the frame and a lock receiving mechanism configured to receive a lock. The lock configured to lock the panel in the fully open position and lock the panel in the closed position. The dual entry safety cuff porter further includes a flange on the panel, the flange configured to stop the panel in the fully open position.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
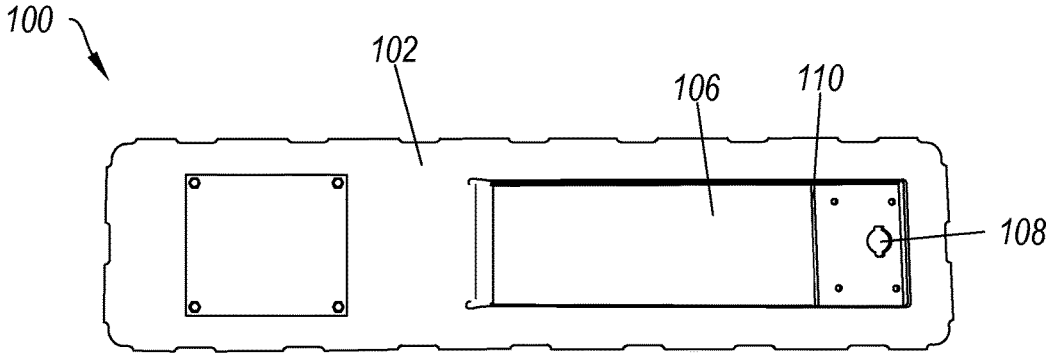
FIG. 1A illustrates an example of a dual entry safety cuff port in a closed position.
Figure 1B:
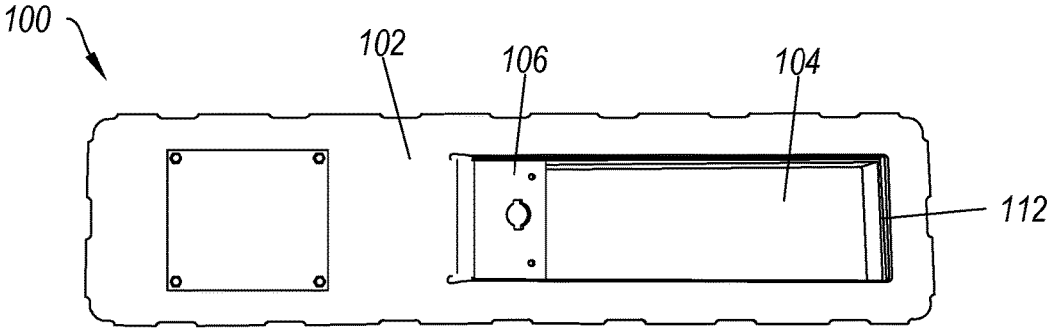
FIG. 1B illustrates an example of a dual entry safety cuff port in an open position.

FIGS. 1A and 1B (collectively "FIG. 1") illustrate an example of a dual entry safety cuff port 100. FIG. 1A illustrates the example of a dual entry safety cuff port 100 in a closed position; and FIG. 1B illustrates the example of a dual entry safety cuff port 100 in an open position. A dual entry safety cuff port is a door within a door. Dual entry safety cuff ports are used as a way to access the hands of a prisoner when they are in a prison cell. Specifically, in correctional institutions dual entry safety cuff ports are used in cell doors and other doors where needed. A correctional officer opens the dual entry safety cuff port and has the inmate place his or her hands through the opening so the officer can place restraints, such as handcuffs or zip cuffs, on the prisoner. Alternatively, the correctional officer can pass food, clothing, correspondence, toiletries or other items through the dual entry safety cuff port to the prisoner without needing to open the cell door.

Violent inmates will sometimes use any means to attack correctional officers. This can make the delivering of meals or correspondence a danger to staff and even life threatening. Physical attacks, bodily fluid attacks and even the airborne transfer of diseases are a daily occupational hazard for many officers. The dual entry safety cuff port 100 is designed to protect the officer and maintain a safe transfer of meals or materials and prevent any direct contact between the inmate and correctional staff.

FIG. 1 shows that the dual entry safety cuff port 100 can include a frame 102. The frame 102 is configured to secure the dual entry safety cuff port to a cell door. That is, the frame 102 will be welded, or otherwise bonded, to the cell door. The frame 102 can be configured to retrofit into existing cell doors. For example, the frame 102 can be approximately 36 inches long, 9 inches high and 2 inches thick, allowing the frame 102 to be attached to an existing door of 38 inches or wider. As used in the specification and the claims, the term approximately shall mean that the value is within 10% of the stated value, unless otherwise specified.

Additionally, it is critical that the frame 102 be able to secure to the door and protect the other portions of the dual entry safety cuff port 100 in the face of action to damage the dual entry safety cuff port by a prisoner, such as prying or other blunt force attacks. For example, the frame 102 and other components can be made of heavy steel for durability. Likewise, the frame 102 can fully enclose other components making it virtually impossible to damage by human hand. Further, the frame 102 can hold together the other components. By encasing the other components in the frame 102, it is easier to install into new doors and retro-fit in existing doors with ease. That is, the frame 102 will absorb any attempted damage without weakening the integrity of the other components. As used in the specification and the claims, the phrase "configured to" denotes an actual state of configuration that fundamentally ties recited elements to the physical characteristics of the recited structure. That is, the phrase "configured to" denotes that the element is structurally capable of performing the cited element but need not necessarily be doing so at any given time. As a result, the phrase "configured to" reaches well beyond merely describing functional language or intended use since the phrase actively recites an actual state of configuration.

FIG. 1 also shows that the dual entry safety cuff port 100 can include an opening 104. The opening 104 allows materials to be passed through the dual entry safety cuff port 100 or allows a prisoner to place his/her hands through the dual entry safety cuff port so that restraints can be placed on his/her hands or wrists. For example, the opening 104 can be approximately 5 inches tall by 14 inches long. The size of the opening 104 is critical to ensure that the prisoner can expose his/her hands but cannot otherwise attempt escape or try to use a homemade weapon to attack a correctional officer.

FIG. 1 further shows that the dual entry safety cuff port 100 can include a panel 106. The panel 106 is configured to slide within the frame 102 between a fully open position and a closed position. In the open position, materials or the prisoner's hands can be passed through the opening 104 and in the closed position the panel 106 completely blocks the opening 104 preventing passage of materials or the prisoner's hands. The panel 106 is approximately 7.5 inches tall and 15 inches long to ensure that at least three sides of the panel 106 remain within the frame 102 (specifically, the left, top and bottom as viewed in FIG. 1B) when the panel is closed and at least two sides of the panel 106 remain within the frame 102 (specifically, the top and bottom as viewed in FIG. 1B) when the panel is open. The panel 106 can be configured to prevent a prisoner from being able to damage the panel 106. For example, the panel 106 can be an approximately ¼-inch plate of steel.

FIG. 1 moreover shows that the panel 106 can include a lock receiving mechanism 108. Typically, in dual entry safety cuff ports the locks are sold separately and different correctional facilities uses different locks. Therefore, the dual entry safety cuff port 100 is configured to receive different locks. The panel 106 locks in both the fully open position and the closed position. If the panel cannot be locked in the open position, then a prisoner could possible close the panel 106 and injure an officer who is passing materials through the opening 104.

FIG. 1 additionally shows that the panel 106 can include a flange 110. The flange 110 is configured to stop the panel in the fully open position. That is, the flange 110 prevents the panel 110 from being over inserted into the frame, which would damage the lock or prevent the panel from being closed.

FIG. 1 also shows that the dual entry safety cuff port 100 can include a channel 112. The channel 112 receives the panel 106. That is the channel 112 allows the panel to be moved relative to the frame. The channel 112 can be splash resistant to prevent debris from entering the channel 112 and preventing the panel 106 from being closed. That is, the channel 112 can be designed to make it difficult for a prisoner to put an object in the channel 112 to interfere with the operation of the panel 106.

Figure 2:
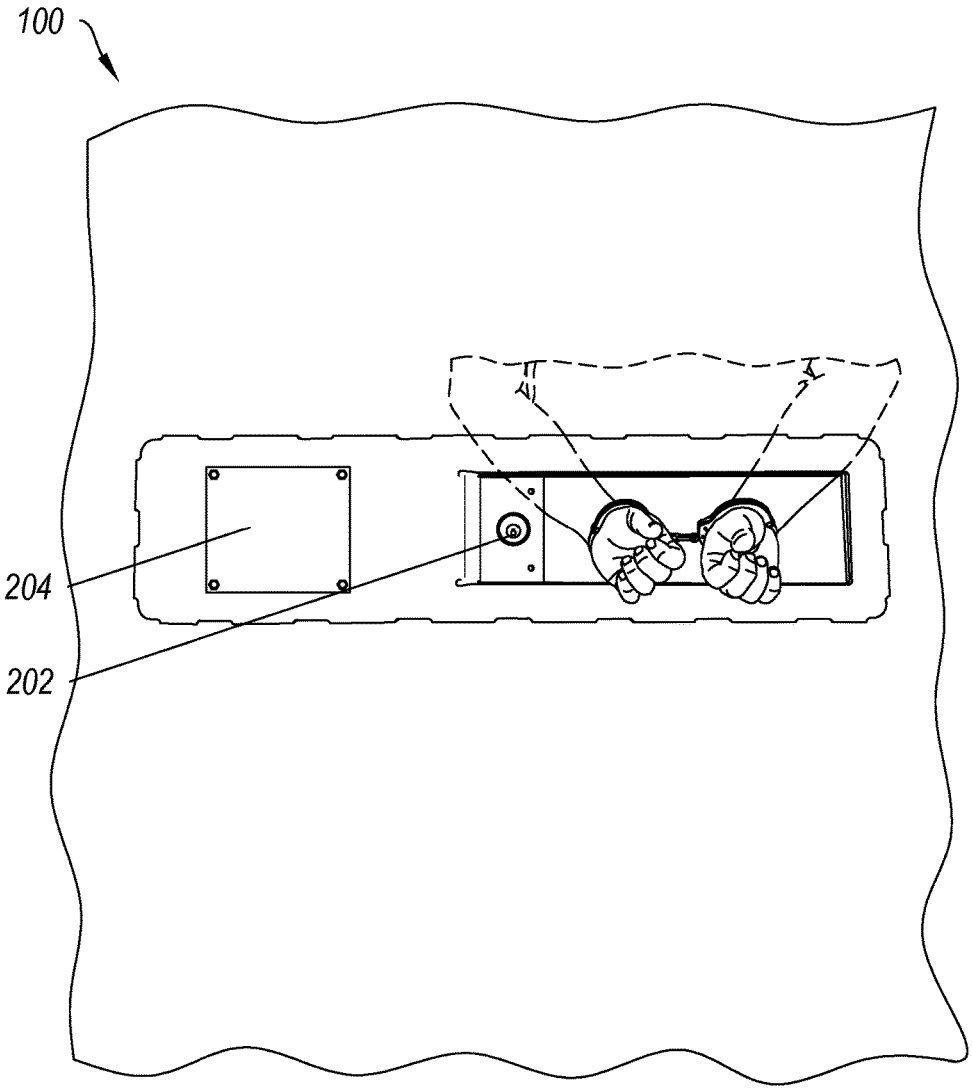
FIG. 2 illustrates an example of a dual entry safety cuff port 100 in use.

FIG. 2 illustrates an example of a dual entry safety cuff port 100 in use. A prisoner can place his/her hands through the dual entry safety cuff port 100 for restraint. For example, since only the hands of the prisoner can pass though the dual entry safety cuff port 100 handcuffs can be placed on the wrists of the prisoner.

FIG. 2 shows that the dual entry safety cuff port 100 can include a lock 202. For example, common locks used in correctional facilities include Folger adam 10 locks, Southern Steel 1010 locks, Southern Steel 1010A locks, Adtec 4010 locks, Airteq 5010 locks, RR Brinks 7010 locks and others. The lock 202 can allow the panel 106 to be opened from either side of the door. This is critical for allowing the officer to gain control of a situation and obtain compliance of the inmates from either side of the secure door without placing the officer at risk of serious injury.

FIG. 2 also shows that the dual entry safety cuff port 100 can include an access panel 204. The access panel 204 can allow the dual entry safety cuff port 100 to be maintained.

That is, the access panel 204 can be opened to allow access to the inner workings of the dual entry safety cuff port 100. The access panel 204 is only on a single side of the dual entry safety cuff port so that a prisoner cannot access the interior of the dual entry safety cuff port 100 and disable the dual entry safety cuff port 100.

Figure 3:
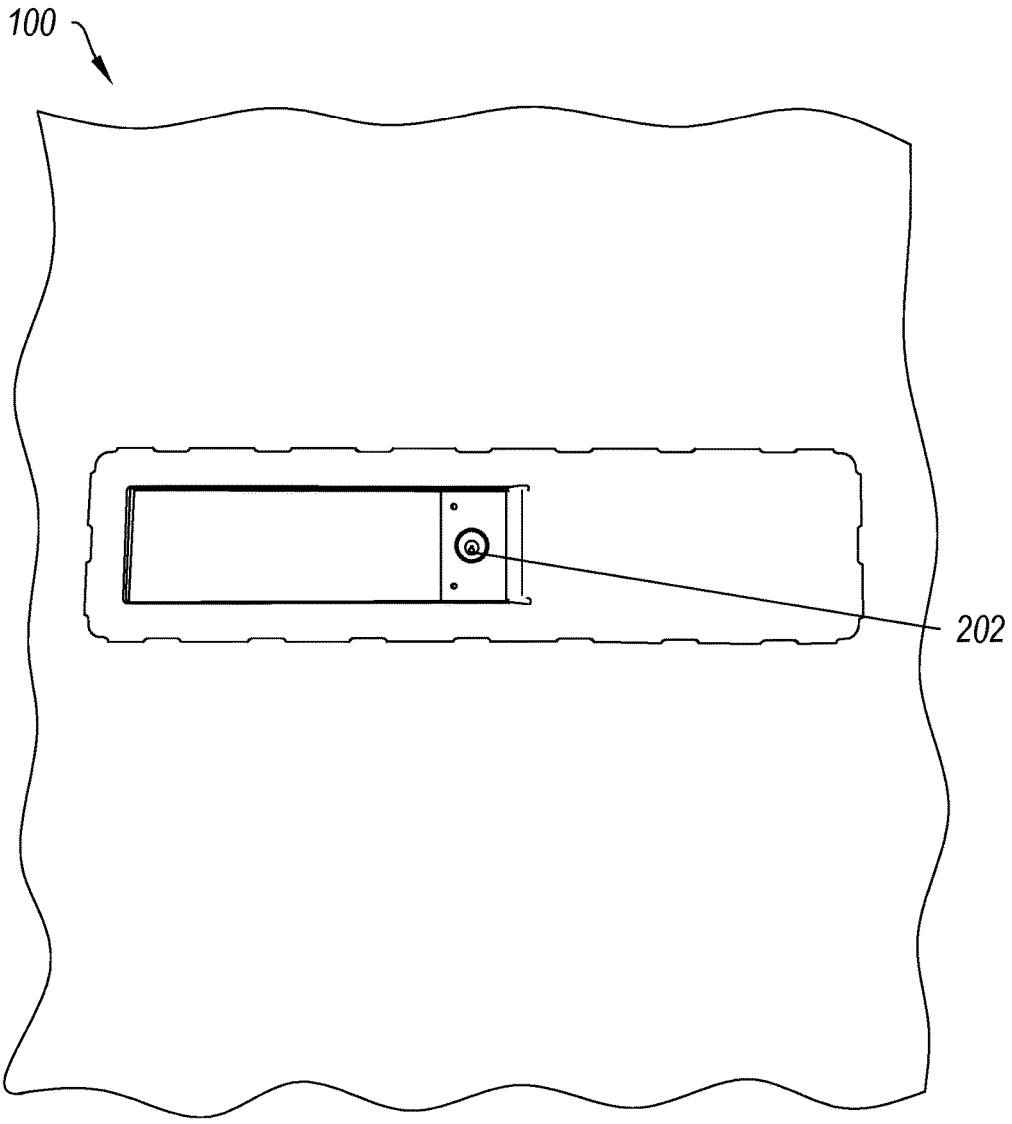
FIG. 3 illustrates an example of a dual entry safety cuff port in use.

FIG. 3 illustrates an example of a dual entry safety cuff port 100 in use. A prisoner can place his/her hands through the dual entry safety cuff port 100 for restraint. For example, since only the hands of the prisoner can pass though the dual entry safety cuff port 100 handcuffs can be placed on the wrists of the prisoner.

FIG. 3 shows that the lock 202, or a portion thereof, can extend through the panel.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A dual entry safety cuff port for use in a correctional facility, the dual entry safety cuff port comprising:
- a frame, the frame including:
  - a first face; and
  - a second face, the second face opposite the first face;
- a panel having at least three perimeter edges fully enclosed by the frame, the panel:
  - configured to slide within the frame between a fully open position and a closed position; and
  - including:
    - a first surface, the first surface parallel to the first face; and
    - a second surface, the second surface opposite the first surface and parallel to the second face;
- a lock on the panel, the lock configured to:
  - allow operation of the lock from both the first surface and the second surface of the panel;
  - allow operation of the panel from both the first surface and the second surface of the panel; and
  - prevent movement of the panel when locked in the fully open position and the closed position;
  - wherein operation of the lock includes locking and unlocking the lock from both the first surface and the second surface of the panel;
  - wherein operation of the panel includes using the lock to apply force to slide the panel within the frame between the fully open position and the closed position;
- a flange on the panel, the flange configured to stop the panel in the fully open position; and
- an access panel on the first face of the frame, wherein the access panel is configured to allow access to the interior of the frame.

2. The dual entry safety cuff port of claim 1, wherein the lock is further configured to:
- lock the panel in the fully open position by engaging with the frame; and
- lock the panel in the closed position by engaging with the frame.

3. The dual entry safety cuff port of claim 1, wherein the frame is approximately 36 inches long.

4. The dual entry safety cuff port of claim 1, wherein the frame is approximately 9 inches high.

5. The dual entry safety cuff port of claim 1, wherein the frame is approximately 2 inches thick.

6. The dual entry safety cuff port of claim 1, wherein the frame is steel.

7. The dual entry safety cuff port of claim 1, wherein the panel is approximately 15 inches long.

8. The dual entry safety cuff port of claim 1, wherein the panel is approximately 7.5 inches tall.

9. The dual entry safety cuff port of claim 1, wherein the panel is approximately ¼ inch wide.

10. The dual entry safety cuff port of claim 1, wherein the panel is steel.

11. A dual entry safety cuff port for use in a correctional facility, the dual entry safety cuff port comprising:
- a frame, the frame including:
  - steel tubing configured to be bonded to a steel security door;
  - a first face; and
  - a second face, the second face opposite the first face;
- an opening within the frame, the opening extending from the first face to the second face;
- a panel within the opening having at least three perimeter edges fully enclosed by the frame, the panel:
  - configured to slide within the frame between a fully open position and a closed position, wherein the panel completely blocks the opening in the fully closed position; and
  - including:
    - a first surface, the first surface parallel to the first face; and
    - a second surface, the second surface opposite the first surface and parallel to the second face;
- a lock on the panel, the lock configured to:
  - allow operation of the lock from both the first surface and the second surface of the panel;
  - allow operation of the panel from both the first surface and the second surface of the panel;
  - lock the panel in the fully open position by engaging with the frame;
  - lock the panel in the closed position by engaging with the frame; and
  - prevent movement of the panel when locked in the fully open position and the closed position;
  - wherein operation of the lock includes locking and unlocking the lock from both the first surface and the second surface of the panel;
  - wherein operation of the panel includes using the lock to move the panel to any state between the fully open position and the closed position;
- a flange on the panel, the flange configured to stop the panel in the fully open position; and
- an access panel on the first face of the frame, wherein the access panel is configured to allow access to the interior of the frame.

12. The dual entry safety cuff port of claim 11, wherein the opening is approximately 5 inches tall.

13. The dual entry safety cuff port of claim 11, wherein the opening is approximately 14 inches long.

14. The dual entry safety cuff port of claim 11, wherein the panel completely covers the opening when in the closed position.

15. A dual entry safety cuff port for use in a correctional facility, the dual entry safety cuff port comprising:

a frame, the frame including:

steel tubing configured to be bonded to a steel security door;

a first face; and a second face, the second face opposite the first face;

an opening within the frame, the opening extending from the first face to the second face;

a channel in at least a portion of the perimeter of the opening;

a panel within the opening having at least three perimeter edges fully enclosed by the frame, the panel:

configured to:

reside at least partially within the channel; and slide within the frame between a fully open position and a closed position, wherein the panel completely blocks the opening in the closed position; and including:

a first surface, the first surface parallel to the first face; and a second surface, the second surface opposite the first surface and parallel to the second face;

an access panel secured to the first face of the frame, wherein the access panel allows access to the interior of the frame from only the first face of the frame;

a lock receiving mechanism on the panel, the lock receiving mechanism configured to receive a lock which locks and unlocks on both the first surface and the second surface of the panel by engaging with the frame; and a flange on the panel, the flange configured to stop the panel in the fully open position.

16. A correctional facility door including the dual entry safety cuff port of claim 15.

17. The correctional facility door of claim 16, wherein the dual entry safety cuff port is welded to the correctional facility door.

18. The dual entry safety cuff port of claim 15, wherein the channel is splash resistant.

19. The dual entry safety cuff port of claim 15, wherein at least two sides of the panel remain within the channel when in the fully open position.

20. The dual entry safety cuff port of claim 15, wherein the at least three perimeter edges of the panel remain within the channel when in the closed position.

* * * * *